US008369533B2

(12) United States Patent
Konagai et al.

(10) Patent No.: US 8,369,533 B2
(45) Date of Patent: Feb. 5, 2013

(54) ARRAY SPEAKER APPARATUS

(75) Inventors: Yusuke Konagai, Hamamatsu (JP); Susumu Takumai, Hamamatsu (JP)

(73) Assignee: Yamaha Corporation (JP)

( * ) Notice: Subject to any disclaimer, the term of this patent is extended or adjusted under 35 U.S.C. 154(b) by 827 days.

(21) Appl. No.: 12/357,147

(22) Filed: Jan. 21, 2009

(65) Prior Publication Data

US 2009/0129602 A1 May 21, 2009

Related U.S. Application Data

(63) Continuation of application No. 10/579,895, filed as application No. PCT/JP2004/017639 on Nov. 19, 2004, now abandoned.

(30) Foreign Application Priority Data

Nov. 21, 2003 (JP) ..... 2003-392085

(51) Int. Cl.
*H04R 5/00* (2006.01)

(52) U.S. Cl. ..... 381/17; 381/98; 381/99; 381/97; 381/61

(58) Field of Classification Search ..... 381/17–18, 381/104, 106, 300, 303, 306–307, 98–99, 381/97, 61
See application file for complete search history.

(56) References Cited

U.S. PATENT DOCUMENTS

| | | | | |
|---|---|---|---|---|
| 5,068,897 | A | 11/1991 | Yamato et al. | |
| 5,109,416 | A | 4/1992 | Croft | |
| 5,233,664 | A * | 8/1993 | Yanagawa et al. | 381/89 |
| 5,325,435 | A | 6/1994 | Date et al. | |
| 5,809,150 | A | 9/1998 | Eberbach | |
| 5,953,432 | A * | 9/1999 | Yanagawa et al. | 381/335 |
| 6,005,947 | A | 12/1999 | Lim | |
| 6,128,395 | A * | 10/2000 | De Vries | 381/387 |
| 6,169,806 | B1 | 1/2001 | Kimura et al. | |
| 6,343,132 | B1 | 1/2002 | Fukuhara et al. | |
| 6,816,597 | B1 * | 11/2004 | Kawano | 381/17 |
| 7,092,541 | B1 * | 8/2006 | Eberbach | 381/300 |
| 2004/0047479 | A1 * | 3/2004 | Porzilli et al. | 381/182 |
| 2006/0050897 | A1 * | 3/2006 | Asada et al. | 381/98 |

FOREIGN PATENT DOCUMENTS

| | | | |
|---|---|---|---|
| DE | 4013398 | A1 | 10/1990 |
| JP | 6-178379 | A | 6/1994 |
| JP | 7-87590 | A | 3/1995 |
| JP | 2000-36993 | A | 2/2000 |
| JP | 2002-525961 | A | 8/2002 |
| JP | 2003-510924 | A | 3/2003 |
| JP | 2004-179711 | A | 6/2004 |

OTHER PUBLICATIONS

Supplementary European Search Report issued in corresponding European Patent Application No. 04799841.4 dated Dec. 7, 2009.
International search report issued in PCT/JP2004/017639, dated Dec. 24, 2004.
Notification of Reason for Refusal issued in JP application No. 2003-392085, dated Jan. 22, 2008.

* cited by examiner

*Primary Examiner* — Disler Paul
(74) *Attorney, Agent, or Firm* — Rossi, Kimms & McDowell LLP

(57) ABSTRACT

An array speaker apparatus SParray includes a first radiation means for driving speaker units so that a first sound S1 of a main channel is radiated to a wall surface W1 on the left or right side of a listening position, and a second radiation means for driving the speaker units so that a second sound S2 the same as the first audio signal is radiated directly to the listening position.

12 Claims, 7 Drawing Sheets

ARRAY SPEAKER APPARATUS

CROSS-REFERENCE TO RELATED APPLICATIONS

This application is a continuation of and claims priority, from U.S. patent application Ser. No. 10/579,895 filed on Jul. 18, 2006, which in turn is a U.S. National Phase Application of and claims priority from PCT International Application PCT/JP2004/017639 filed on Nov. 19, 2004, which in turn claims priority from Japanese Application No. 2003-392085 filed Nov. 21, 2003.

TECHNICAL FIELD

The present invention relates to an array speaker apparatus in which audio signals radiated from a plurality of speaker units are reflected by wall surfaces so as to generate a phantom sound image.

BACKGROUND ART

Recently, in some audio sources such as DVD, multi-channel audio signals of 5.1 channels or the like are recorded. Digital surround-sound systems for reproducing such audio sources have been dominating even in general homes. FIG. 10 is a plan view showing an example of a speaker layout in a digital surround-sound system, in which Zone represents a listening room where surround-sound is reproduced; U, a listening position; SP-L and SP-R, main speakers for reproducing main signals L (left) and R (right); SP-C, a center speaker for reproducing a center signal C (center); SP-SL and SP-SR, rear speakers for reproducing rear signals SL (rear left) and SR (rear right); SP-SW, a subwoofer for reproducing a subwoofer signal LFE (lower frequency); and MON, a video apparatus such as a television set or the like.

According to the digital surround-sound system in FIG. 10, an effective sound field can be created. In the digital surround-sound system, however, a plurality of speakers are disposed to disperse in the listening room Zone so that the rear speakers SP-SL and SP-SR for surround sound are disposed at the rear of the listening position U. Thus, there are drawbacks that the speaker lines of the rear speakers SP-SL and SP-SR become long, and that the layout of the rear speakers SP-SL and SP-SR is bound by the shape of the listening room Zone, furniture, etc.

As a means for relaxing such drawbacks, there has been proposed a surround-sound system in which highly directional speakers are disposed in front of the listening position in place of the rear speakers, and acoustic reflectors are disposed at the rear of the listening position so that surround-channel sounds radiated from the directional speakers are reflected by the acoustic reflectors so as to obtain the same effect as that by the rear speakers disposed at the rear of the listening position (for example, see Patent Document JP-A-06-178379). A method in which wall surfaces at the rear of the listening position are used as acoustic reflectors can be also considered.

A delay array system has been known as a system for controlling the directivities with which sounds are radiated to acoustic reflectors or wall surfaces. The principles of the array speaker will be described below with reference to FIG. 11. A large number of miniaturized speakers 101-1 to **101-*n* are disposed one-dimensionally. Assume that an arc whose distance from a position (focus) P of the wall surfaces or the acoustic reflectors is L is Z. Extend straight lines connecting the focus P with the speakers 101-1 to 101-*n*** respectively.

Consider that virtual speakers 102-1 to **102-*n* as shown by the broken lines in FIG. 11 are disposed on the intersection points where these extended straight lines intersect the arc Z. Since all the distances between these virtual speakers 102-1 to 102-*n* and the focus P are L, sounds simultaneously radiated from the speakers 102-1 to 102-*n*** arrive at the focus P simultaneously.

In order that a sound radiated from each real speaker **101-*i* (i=1, 2, . . . n) is made to arrive at the focus P simultaneously, it will go well if a delay (time difference) corresponding to a distance between the speaker 101-*i* and a virtual speaker 102-*i* corresponding thereto is added to the sound output from the speaker 101-*i*. That is, control is made so that a listener located in the focus P can feel as if the virtual speakers 102-1 to 102-*n* were disposed on the arc Z. In this manner, the phases of the outputs of the speakers 101-1 to 101-*n*** can be tuned up in the focus P so as to create a mountain of sound pressure. As a result, a sound pressure distribution with directivity felt as if acoustic beams are emitted toward the focus P can be obtained.

When the speakers are disposed not one-dimensionally but two-dimensionally, acoustic beams with three-dimensional directivity can be output. The array speaker has an advantage in that sounds corresponding to a plurality of audio signals respectively can be radiated with different directivities simultaneously, that is, acoustic beams of a plurality of channels can be output simultaneously. Patent Document JP-T-2003-510924 has proposed a multi-channel surround-sound system using an array speaker. When the array speaker is used, a 5.1-channel surround-sound system can be produced by the array speaker alone as shown in FIG. 12. In FIG. 12, SP-L' and SP-R' designate virtual main speakers formed in left and right wall surfaces, and SP-SL' and SP-SR' designate virtual rear speakers formed in a rear wall surface.

While having the advantage as described above, surround-sound systems using an array speaker also have some problems in practical use. The first problem is the point that the sound image fixed-positions of the main channels (main signals L and R) are wrong. In a surround-sound system using an array speaker, main signals L and R are radiated from the array speaker toward the left and right walls as shown in FIG. 12. Due to sounds reflected by the left and right walls, the listener feels as if sound sources, that is, virtual main speakers SP-L' and SP-R' were located near the walls. However, the layout where the virtual main speakers SP-L' and SP-R' are disposed in the left and right wall surfaces as shown in FIG. 12 differs from the general layout of speakers shown in FIG. 10. Therefore, the reproducing environment differs from the environment intended by a creator of contents. Particularly in the case of old contents including no center signal C, a sound image to be fixed on a screen is expected to be obscure. Such a problem becomes more conspicuous in a room which is left-right asymmetric or a room which is long from side to side.

The second problem is the point that the sense of the sound image fixed-positions of the surround channels (rear signals SL and SR) are wrong. The rear signals SL and SR avoiding the listening position U and reflected by the left and right walls or the ceiling or by both the left and right walls and the ceiling are reflected by the rear wall and arrive at the listening position U. Thus, the listener feels the sound image fixed-positions at the rear of the listener. In fact, however, each acoustic beam merely creates an intensive directivity distribution. Each acoustic signal spreads in any direction other than the beam direction. The energy in any direction other than the beam direction is merely weaker than the energy in the beam direction. Accordingly, when a direct sound from the array speaker is not much weaker than its beam traveling via the wall, the sound image fixed-position is felt to be closer to the array speaker. Any surround channel has a larger distance from the listener than any main channel. When the distance to the listener is larger, the energy of an audio signal is attenuated disadvantageously to the ratio to the direct sound. In addition, when the distance is larger, it takes more time to arrive at the listening position U. Thus, the sound image is apt to be fixed on the direct sound side due to the Hass effect.

Particularly, there is a problem in difficulty to control a low frequency. The main lobe width of directivity which is the thickness of the acoustic beam depends on the ratio between the wavelength of a signal and the width of the array speaker. Therefore, a high frequency signal forms a narrow beam, and a low frequency signal forms a wide beam. That is, the directivity varies in accordance with the frequency. In order to form an audio signal of one frequency band into a beam, the array width has to be several times as long as the wavelength of the signal. For example, when the frequency is 500 Hz, the wavelength is about 60 cm. The required array width is about 2 m, which is not the practical size for general home use. In such a manner, since intensive directivity cannot be given to a low-frequency signal, the energy of a direct sound overcomes the energy of a reflected beam. Accordingly, a high-frequency signal is fixed on the rear wall side while a low-frequency signal is listened to directly from the array speaker. Thus, the sound image may be separated, or the sense of fixation thereof may be wrong.

SUMMARY OF THE INVENTION

The present invention was developed to solve the foregoing problems. An object of the invention is to provide an array speaker apparatus which can obtain an excellent sound image fixed-position in a multi-channel surround-sound system using the array speaker apparatus.

In order to solve the foregoing problems, the present invention proposes the following arrangement for solving the problems, namely, an array speaker apparatus in which sounds radiated with directivities from a plurality of speaker units in accordance with an audio signal are reflected by wall surfaces so as to generate a virtual sound source, comprising: first radiation control means for driving the speaker units so that sounds corresponding to a first audio signal of each main channel are radiated to the wall surfaces on the left and right sides of a listening position; and second radiation control means for driving the speaker units so that sounds corresponding to a second audio signal the same as the first audio signal are radiated directly to the listening position.

The array speaker apparatus preferably further includes means for correcting one or both of a frequency-gain characteristic and a frequency-phase characteristic of at least the first audio signal out of the first audio signal and the second audio signal so that sounds arriving at the listening position have desired properties.

In accordance with the invention, an array speaker apparatus in which sounds radiated with directivities from a plurality of speaker units in accordance with an audio signal are reflected by wall surfaces so as to generate a virtual sound source, includes: a high pass filter for extracting a first audio signal of a middle/high frequency band from an input audio signal of each surround channel; a low pass filter for extracting a second audio signal of a low frequency band from the input audio signal; first radiation control means for driving the speaker units so that sounds corresponding to the first audio signal are reflected by the wall surface behind a listening position and then reach the listening position; and a second radiation control means for driving the speaker units so that a sound pressure level of sounds corresponding to the second audio signal reaching the listening position is smaller than a sound pressure level of sounds corresponding to the first audio signal reaching the listening position.

In the array speaker apparatus according to the above, assuming that a spatial point where sounds radiated from the plurality of speaker units arrive simultaneously is regarded as a focus, the first radiation control means and the second radiation control means preferably drive the speaker units so that a focus of sounds corresponding to the second audio signal is set to be farther than a focus of sounds corresponding to the first audio signal.

In the array speaker apparatus according to the above, the first radiation control means and the second radiation control means preferably drive the speaker units so that an angle between a radiation direction of sounds corresponding to the second audio signal and a frontal direction of the array speaker apparatus is larger than an angle between a radiation direction of sounds corresponding to the first audio signal and the frontal direction.

The invention further provides an array speaker apparatus with a plurality of speaker units, comprising: a first audio signal generating circuit that generates first audio signals based on an input audio signal; a second audio signal generating circuit that generates second audio signals based on the input signal; adders that add the first audio signals to the second audio signals and input addition results to the plurality of speaker units; and a directivity control unit that controls directivities of first output sounds output by the plurality of speaker units based on the first audio signals, and directivities of second output sounds output by the plurality of speaker units based on the second audio signals.

According to the array speaker apparatus discussed above, the first audio signal generating circuit and the second audio signal generating circuit preferably include delay circuits for delaying input signals, respectively; and the directivity control unit preferably controls the delay circuits so as to realize the directivities of the first output sounds and the directivities of the second output sounds.

According to the array speaker apparatus discussed above, the first audio signal generating circuit and the second audio signal generating circuit further preferably include characteristic correction circuits for performing desired characteristic correction upon the input signals, respectively.

According to the array speaker apparatus discussed above, the characteristic correction circuit of the first audio signal generating circuit preferably includes a high pass filter, and the characteristic correction circuit of the second audio signal generating circuit includes a low pass filter.

According to the array speaker apparatus discussed above, the first audio signal generating circuit and the second audio signal generating circuit preferably include multipliers for adjusting signals delayed by the delay circuits into desired levels, respectively.

According to the array speaker apparatus discussed above, the multipliers are preferably provided for the speaker units, respectively; and a gain coefficient of at least one of the multipliers of the first audio signal generating circuit is zero.

The invention further provides an array speaker apparatus with a plurality of speaker units, comprising: a delay circuit that delays an input signal by delay times set for the speaker units respectively; a directivity control unit that controls the delay times of the delay circuit so as to determine directivities of output sounds output by the plurality of speaker units; and filters that are provided for the speaker units respectively, and filter outputs of the delay circuit and output the filtered outputs to the speaker units; wherein cut-off frequencies of the filters are different from one another.

According to the array speaker apparatus discussed above, each of the cut-off frequencies of the filters is preferably set to be lower as a speaker unit corresponding thereto is located at a larger distance from a center of the array speaker.

According to the present invention, a virtual sound source (phantom sound source) can be created between the frontal direction of the listening position and the wall surface by providing a first radiation control means for driving the speaker units so that sounds corresponding to a first audio signal of each main channel are radiated to wall surfaces on the left and right sides of a listening position, and second radiation control means for driving the speaker units so that sounds corresponding to a second audio signal the same as the first audio signal are radiated directly to the listening position. As a result, a good sound image fixed-position of the main channel can be obtained.

When means for correcting one or both of a frequency-gain characteristic and a frequency-phase characteristic of at least the first audio signal of the first audio signal and the second audio signal is provided, sounds arriving at the listening position can be adjusted to have desired properties.

When there are provided a high pass filter for extracting a first audio signal of a middle/high frequency band from an input audio signal of each surround channel, a low pass filter for extracting a second audio signal of a low frequency band from the input audio signal, first radiation control means for driving the speaker units so that sounds corresponding to the first audio signal are reflected by a wall surface behind a listening position and then reach the listening position, and second radiation control means for driving the speaker units so that a sound pressure level of sounds corresponding to the second audio signal reaching the listening position is smaller than a sound pressure level of sounds corresponding to the first audio signal reaching the listening position, the audio signal is divided into two or more frequency bands and controlled as different beams, so that a sound image fixed-position is created by the first audio signal of the middle/high frequency band whose directivity can be controlled, while the second audio signal of the low frequency band whose directivity control is limited is controlled not to create a sound image but to relax the sound image fixed-position on the array speaker side. That is, control is made to prevent the sound image created by the middle/high frequency band from being pulled back to the array speaker side by the low frequency band. As a result, it is possible to obtain a good sound image fixed-position of the surround channels (rear channels).

When the speaker units are driven so that a focus of sounds corresponding to the second audio signal is set to be farther than a focus of sounds corresponding to the first audio signal, the sound image fixed-position on the array speaker side due to the second audio signal can be relaxed.

When the speaker units are driven so that an angle between a radiation direction of sounds corresponding to the second audio signal and a frontal direction of the array speaker apparatus is larger than an angle between a radiation direction of sounds corresponding to the first audio signal and the frontal direction, the sound image fixed-position on the array speaker side due to the second audio signal can be relaxed.

BRIEF DESCRIPTION OF THE DRAWINGS

The invention will be described with reference to certain preferred embodiments thereof and the accompanying figures, wherein.

DETAILED DESCRIPTION OF THE PREFERRED EMBODIMENTS

First Embodiment

An embodiment of the present invention will be described below in detail with reference to the drawings. An array speaker apparatus SParray according to a first embodiment is constituted by a first audio signal generating circuit for generating first audio signals to be radiated to a wall surface W1 on the left or right side of a listening position U based on an input audio signal of one channel of main channels (main signals L and R), a second audio signal generating circuit for generating second audio signals to be radiated directly to the listening position U based on the input audio signal, adders for adding the first audio signals to the second audio signals, and amplifiers for amplifying the outputs of the adders, speaker units to be driven by the amplifiers, and a directivity control circuit constituted by a microcomputer or the like for deciding the directivities of the first audio signals and the second audio signals.

This array speaker apparatus SParray can be implemented by assigning resources of two channels in a background-art array speaker apparatus to an input audio signal of one channel. The first audio signal generating circuit, the adders and the amplifiers constitute a first radiation control means, and the second audio signal generating circuit, the adders and the amplifiers constitute a second radiation control means.

As a recommended example for practical use, it is desired to provide the first audio signal generating circuit and the second audio signal generating circuit with multipliers for adjusting gain ratios between the first audio signals and the second audio signals. It is also desired to provide delay circuits for adjusting times for the first audio signals and the second audio signals to arrive at the listening position. Resources of the background-art array speaker apparatus may be applied to the multipliers and the delay circuits. It is also desired to provide characteristic correction circuits for correcting properties of the first audio signals and the second audio signals at the listening position.

Figure 1:
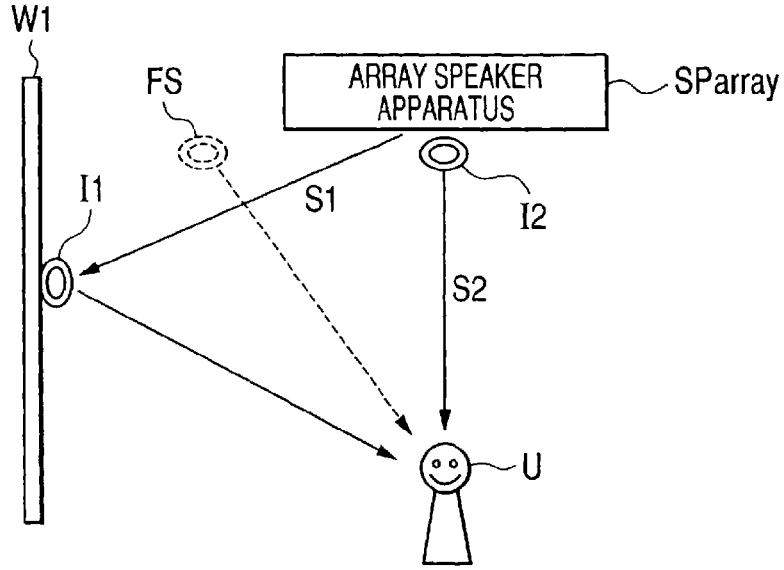
FIG. 1 is a view for explaining the principles of an array speaker apparatus according to a first embodiment of the present invention.

FIG. 1 is a view for explaining the principles of this embodiment. FIG. 1 depicts only an audio signal of one channel. In this embodiment, the array speaker apparatus SParray outputs a first sound S1 which will go through (be reflected by) the wall surface W1 and arrive at the listening position U, and a second sound S2 which will arrive at the listening position U directly from the array speaker apparatus SParray. The first sound S1 and the second sound S2 are of quite the same signal essentially. When the first sound S1 and the second sound S2 arrive at the listening position U, virtual sound sources I1 and I2 are formed on the wall surface W1 and in front of the listening position U respectively. Since the first sound S1 and the second sound S2 are quite the same, a listener feels a sound phantom image FS between the two virtual sound sources I1 and I2, that is, between the front of the listening position and the wall surface W1. This phantom sound image FS is the same as a phantom sound image using stereophonics.

Figure 2:
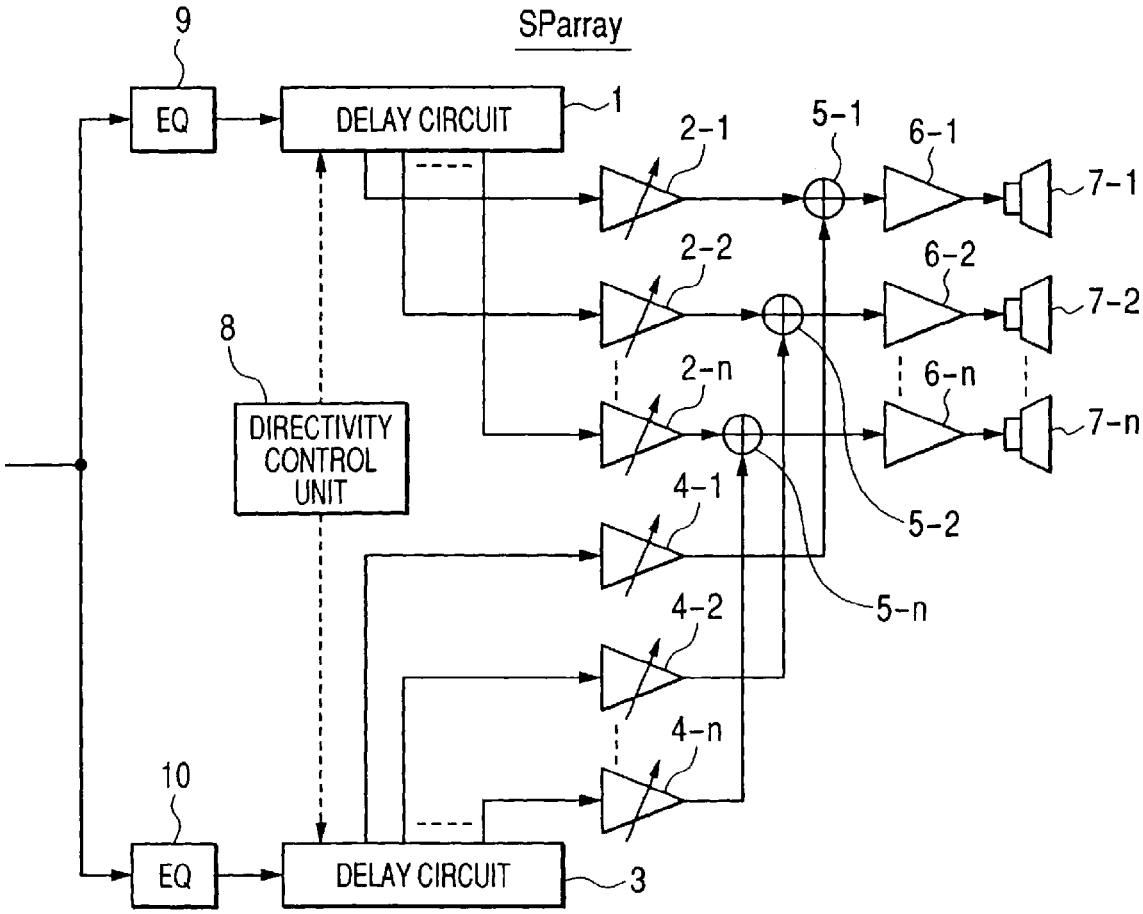
FIG. 2 is a block diagram showing the configuration of the array speaker apparatus according to the first embodiment of the present invention.

FIG. 2 is a block diagram showing the configuration of the array speaker apparatus SParray according to this embodiment. The array speaker apparatus SParray in FIG. 2 includes characteristic correction circuits (EQ) 9 and 10 for performing desired characteristic correction upon an input audio signal, a delay circuit 1 for adding delay times corresponding to intended directivity to an output signal of the characteristic correction circuit 9, multipliers 2 (2-1 to **2-*n*) for multiplying the outputs of the delay circuit 1 by gain coefficients so as to adjust the outputs into desired levels, a delay circuit 3 for adding delay times corresponding to intended directivity to an output signal of the characteristic correction circuit 10, multipliers 4 (4-1 to 4-*n*) for multiplying the outputs of the delay circuit 3 by gain coefficients so as to adjust the outputs into desired levels, adders 5 (5-1 to 5-*n*) for adding output signals of the multipliers 2 to output signals of the multipliers 4, amplifiers 6 (6-1 to 6-*n*) for amplifying output signals of the adders 5, speaker units 7 (7-1 to 7-*n*) to be driven by the amplifiers 6, and a directivity control unit 8 for setting the delay times of the delay circuits 1 and 3. In the same manner as in FIG. 1, an audio signal of one channel is depicted in FIG. 2**.

The characteristic correction circuit 9, the delay circuit 1 and the multipliers 2 constitute the aforementioned first audio signal generating circuit, and the characteristic correction circuit 10, the delay circuit 3 and the multipliers 4 constitute the second audio signal generating circuit.

An input audio signal is input to the first audio signal generating circuit and the second audio signal generating circuit. First, the audio signal input to the first audio signal generating circuit on the upper side of FIG. 2 passes the characteristic correction circuit 9. This characteristic correction circuit 9 will be described later.

The input audio signal having passed the characteristic correction circuit 9 is input to the delay circuit 1 so as to form first audio signals to which delay times are added by the delay circuit 1 respectively and whose number corresponds to the number of speaker units. In this event, the delay time the delay circuit 1 adds to the first audio signal to be supplied to each speaker unit **7-*i* (i=1, 2, . . . n) is adjusted so that a first sound S1 radiated from the speaker unit 7-*i* travels to a focus set in the wall surface W1 direction. That is, the delay time of the delay circuit 1 is calculated for each speaker unit by the directivity control unit 8 based on the position of the focus set in the wall surface W1 direction and the position of each speaker unit 7-1 to 7-*n* in the same manner as in a background-art array speaker apparatus. The delay times calculated thus are set in the delay circuit 1**.

The first audio signals added with the delay times by the delay circuit 1 are adjusted into desired levels by the multipliers 2-1 to **2-*n*. The first audio signals may be multiplied by predetermined window function coefficients by the multipliers 2-1 to 2-*n*** respectively.

On the other hand, the audio signal input to the second audio signal generating circuit on the lower side of FIG. 2 passes the characteristic correction circuit 10. This characteristic correction circuit 10 will be described later.

The input audio signal having passed the characteristic correction circuit 10 is input to the delay circuit 3 so as to form second audio signals to which delay times are added by the delay circuit 3 respectively and whose number corresponds to the number of speaker units. In this event, the delay time the delay circuit 3 adds to the second audio signal to be supplied to each speaker unit **7-*i* (i=1, 2, . . . n) is adjusted so that a second sound S2 radiated from the speaker unit 7-*i* travels directly to the listening position U. That is, the delay time of the delay circuit 3 is calculated for each speaker unit by the directivity control unit 8 based on the position of the focus set in front of the array speaker apparatus SParray and the position of each speaker unit 7-1 to 7-*n*. The delay times calculated thus are set in the delay circuit 3**.

The second audio signals added with the delay times by the delay circuit 3 are adjusted into desired levels by the multipliers 4-1 to **4-*n*. The second audio signals may be multiplied by predetermined window function coefficients by the multipliers 4-1 to 4-*n*** respectively.

Subsequently, the outputs of the multipliers 2-1 to **2-*n* are added to the outputs of the multipliers 4-1 to 4-*n* by the adders 5-1 to 5-*n*. The outputs of the adders 5-1 to 5-*n* are amplified by the amplifiers 6-1 to 6-*n*, and sounds are radiated from the speaker units 7-1 to 7-*n*. Signals output from the speaker units 7-1 to 7-*n* respectively interfere with one another in the space so as to form a beam of the first sound S1 traveling toward the focus on the wall surface W1 side and a beam of the second sound S2 traveling directly to the listening position U. The first sound S1 travels to the listening position U via the wall surface W1, and the second sound S2 travels to the listening position U frontally. The listener feels a sound image fixed-position between the wall surface W1** and his/her front due to his/her human hearing characteristic.

In such a manner, according to this embodiment, it is possible to solve the problem that the sound image fixed-position of the main channels (main signals L and R) is wrong in a surround-sound system using an array speaker.

Figure 11:
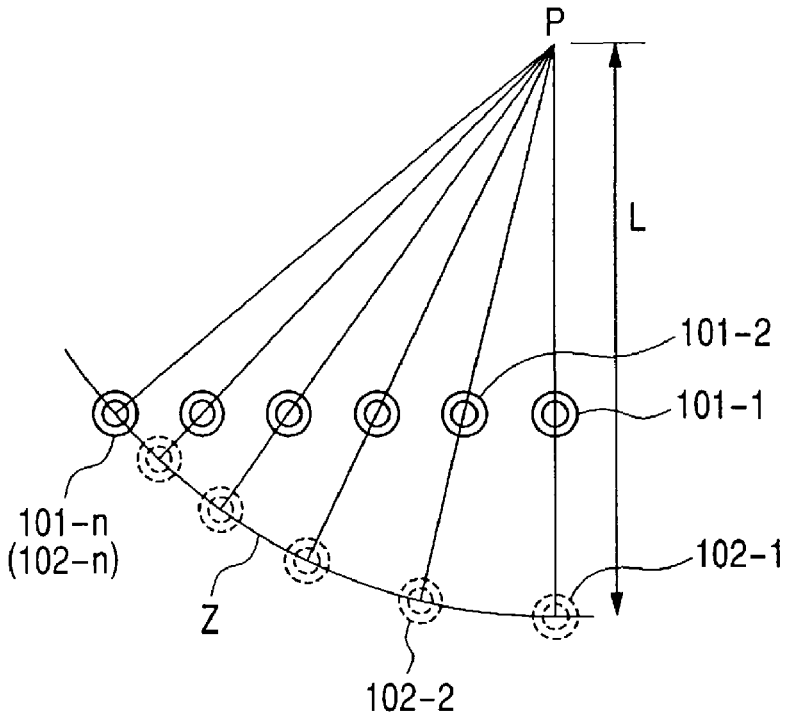
FIG. 11 is a view for explaining the principles of an array speaker.
Figure 12:
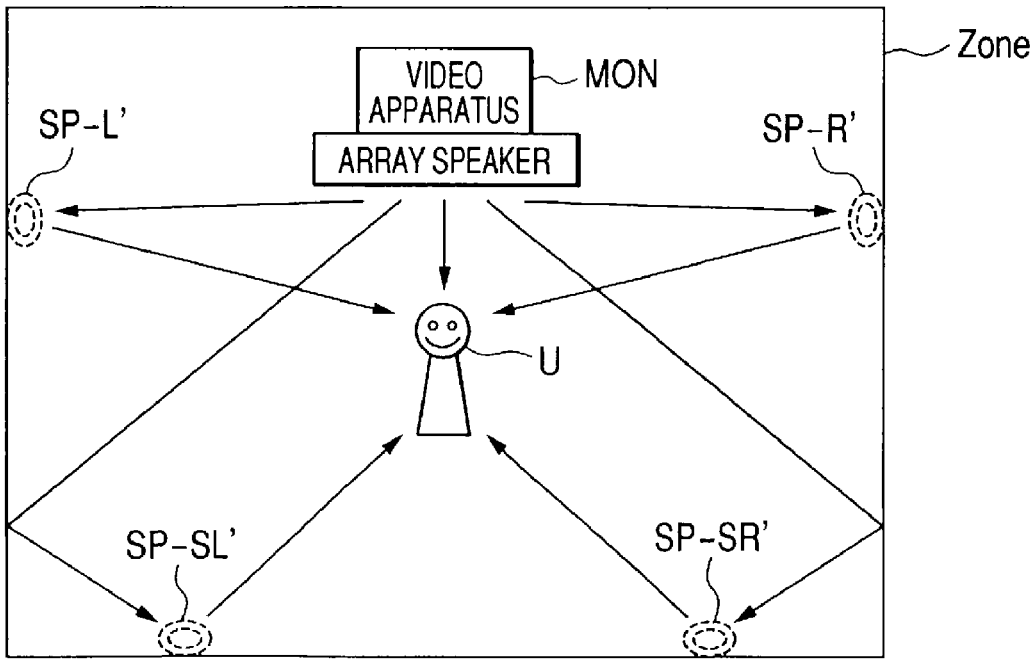
FIG. 12 is a view showing an example of a surround-sound system implemented by an array speaker alone.

Here, the beam control described in FIG. 11 is performed upon the first audio signals, but it may be considered that another control method other than the beam control is applied to the second audio signals in order to obtain more natural audibility. When the beam control is used, it will go well if the focus is set just near the array speaker apparatus SParray. It can be noted that examples of the other control methods include a method in which identical signals are output concurrently from all the speaker units without applying delay control to the second audio signals, a method in which only a spatial window process is performed upon the second audio signals, a method in which special spatial coefficients such as Bessel array are applied to the second audio signals so as to simulate a nondirectional point sound source or a dipole characteristic of a normal speaker, a method in which delay is used to simulate an output as if the output came from one point behind the array speaker, and so on. These controls can be implemented by the configuration shown in FIG. 2.

When the gain ratios between the first audio signals and the second audio signals are changed, the position of the phantom sound image FS can be changed. That is, assume that the gains of the second audio signals are fixed. In this case, when the gains of the first audio signals are increased, the phantom sound image FS approaches the wall surface W1 side. When the gains of the first audio signals are reduced, the phantom sound image FS approaches the array speaker apparatus SParray. The gain ratios can be adjusted by adjustment of the gain coefficients of the multipliers 2 and 4. The directivity control unit 8 calculates the gain coefficients of the multipliers 2 and 4 based on the listening position U, the position of the focus on the wall surface W1 and the position of the phantom sound image FS, and sets them in the multipliers 2 and 4.

In order to control the phantom sound image FS, it is desired that there is no difference in arrival time between the first sound S1 and the second sound S2 listened to in the listening position U. To this end, it will go well if the delay circuits are used to adjust the delay times in the speaker units respectively between the two audio signals so that the first sound S1 and the second sound S2 arrive at the listening position U simultaneously. Fundamentally, since the first sound S1 traveling through the wall surface arrives at the listening position U through a longer distance, it will go well if the second sound S2 side is delayed by a time to compensate the difference between the distance from the array speaker apparatus SParray to the listening position U via the wall surface W1 and the distance from the array speaker apparatus SParray to the listening position U. The delay time required for this can be added by adjusting (adding) delay quantities of the delay circuit 3 passed by the second audio signals. The directivity control unit 8 calculates the delay time to be added to the second audio signals, based on the listening position U and the position of the focus on the wall surface W1. The delay time calculated thus is set in the delay circuit 3.

It is also desired that characteristic correction is performed to improve the acoustic properties formed at the listening position U by the first sound S1 and the second sound S2. Particularly the properties of the first sound S1 traveling via the wall surface W1 are expected to change in accordance with the hardness or material of the wall surface W1. It is therefore preferable to insert the characteristic correction units 9 and 10 before the delay circuits 1 and 3, as shown in FIG. 2. One or both of the frequency-gain characteristic and the frequency-phase characteristic of the input audio signal are corrected by the characteristic correction units 9 and 10 so that the sound listened to in the listening position U has good properties. The characteristic correction units 9 and 10 are constituted by digital filters good in flexibility and controllablility.

Although FIGS. 1 and 2 depict only one channel (main signal L) of the main channels, in fact the aforementioned processing is performed upon each main signal L, R.

As for contents including a center channel, it is possible to use a system in which audio signals (corresponding to the second audio signals) on the direct (frontal directivity) sides of the main signals L and R are added to the center channel in advance. With this system, the process of directivity control and the process of addition can be cut down. However, gain adjustment and delay addition for distance correction are performed for each channel. In this case, these processes are performed in advance, and the aforementioned audio signals are then added to the center channel.

Second Embodiment

Figure 3:
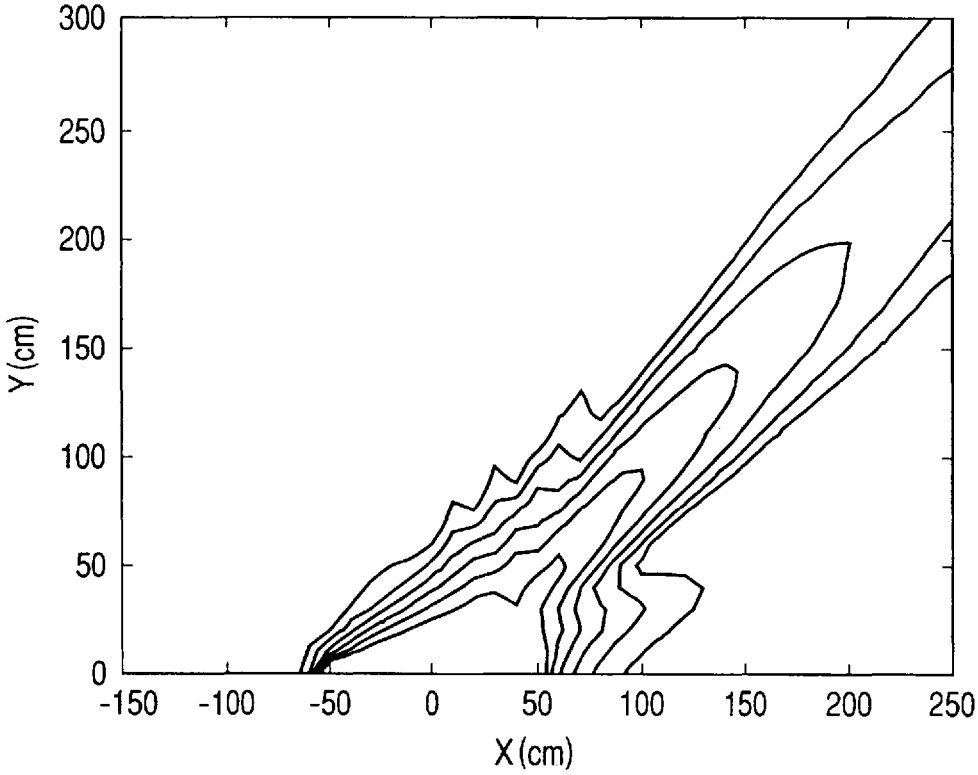
FIG. 3 is a graph showing an example of directivity of a background-art array speaker apparatus.
Figure 4:
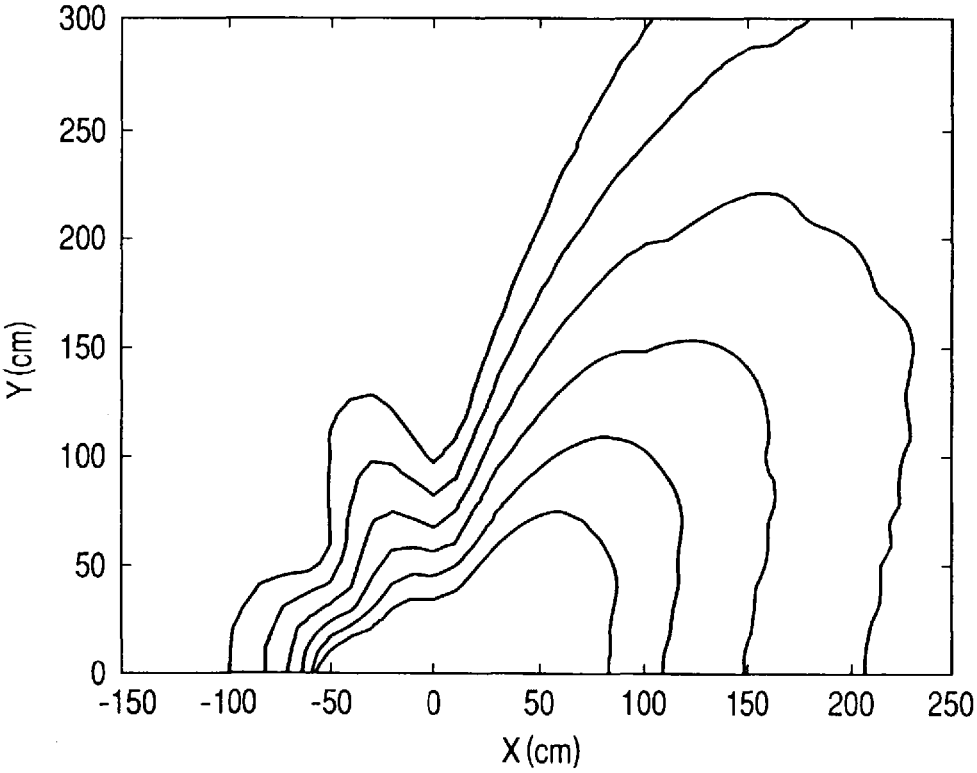
FIG. 4 is a graph showing another example of directivity of the background-art array speaker apparatus.

Next, description will be made about a second embodiment of the present invention. Prior to the description of the second embodiment, description will be made about a change of a beam shape due to a frequency band. When the array speaker width and the set focus are fixed, the higher the frequency is, the acuter the beam is. Each of FIGS. 3 and 4 is a graph showing a simulated example of directivity distribution when a focus was set in the direction of 45° in a background-art array speaker apparatus 95 cm wide. Each of FIGS. 3 and 4 shows contours of sound pressure levels of a single frequency on an XY plane, showing sound pressure levels when a plurality of speaker units were disposed in the X-axis direction around the position of 0 cm in the X axis. The example of FIG. 3 shows a simulated result of a sine wave of 2 kHz, and the example of FIG. 4 shows a simulated result of a sine wave of 500 Hz.

The directivity of a low frequency band is not as acute as that of a high frequency. Accordingly, there is a small difference between the sound pressure energy in the radial direction and the sound pressure energy in the front direction of the array speaker apparatus. This is the point of this embodiment.

The array speaker apparatus SParray according to this embodiment is constituted by a high pass filter for extracting a first audio signal of a middle/high frequency band from an input audio signal of one channel of surround channels, a low pass filter for extracting a second audio signal of a low frequency band not higher than several hundreds of hertz from the input audio signal, a first audio signal processing circuit for processing the first audio signal extracted by the high pass filter, a second audio signal processing circuit for processing the second audio signal extracted by the low pass filter, adders for adding first audio signals to second audio signals, amplifiers for amplifying the outputs of the adders, speaker units to be driven by the amplifiers, and a directivity control circuit constituted by a microcomputer or the like for deciding the directivities of the first audio signals and the second audio signals.

This array speaker apparatus SParray can be implemented by assigning resources of two channels in a background-art array speaker apparatus to an input audio signal of one channel, and adding the high pass filter and the low pass filter. The first audio signal processing circuit, the adders and the amplifiers constitute a first radiation control means, and the second audio signal processing circuit, the adders and the amplifiers constitute a second radiation control means.

As a recommended example for practical use, it is desired to provide the first audio signal processing circuit and the second audio signal processing circuit with multipliers for adjusting gain ratios between the first audio signals and the second audio signals. It is also desired to provide delay circuits for adjusting times for the first audio signals and the second audio signals to arrive at the listening position. Resources of the background-art array speaker apparatus may be applied to the multipliers and the delay circuits. When the number of divided frequency bands increases, it is likely that an effect closer to an ideal can be obtained. In this case, by use of band pass filters together with the low pass filter and the high pass filter, the configuration may be expanded to output a beam for each of three or more bands.

Figure 5B:
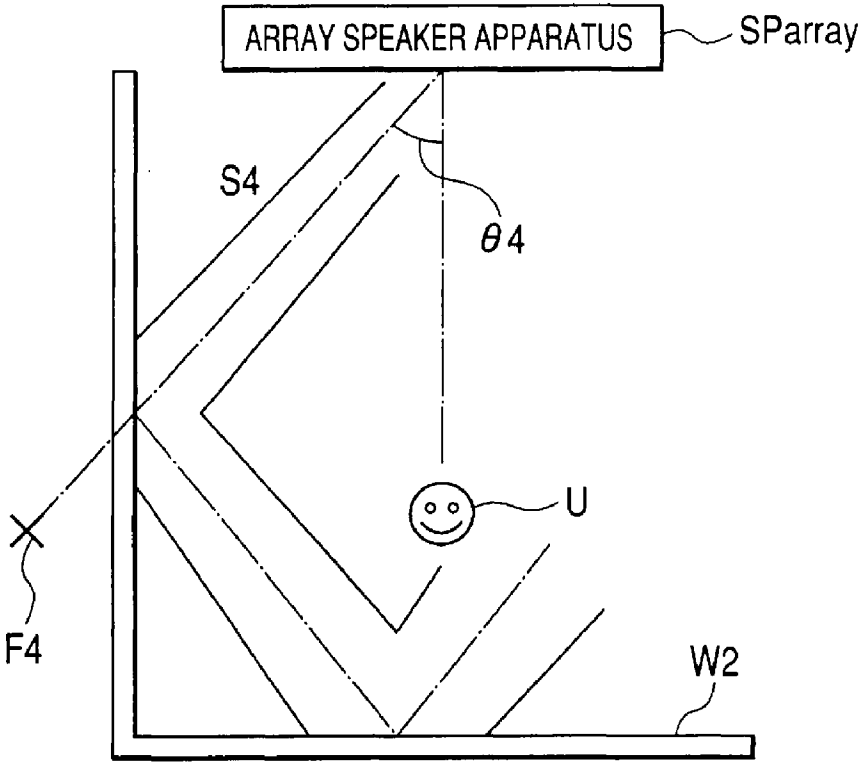
FIG. 5 are views for explaining the principles of an array speaker apparatus according to a second embodiment of the present invention.
Figure 5A:
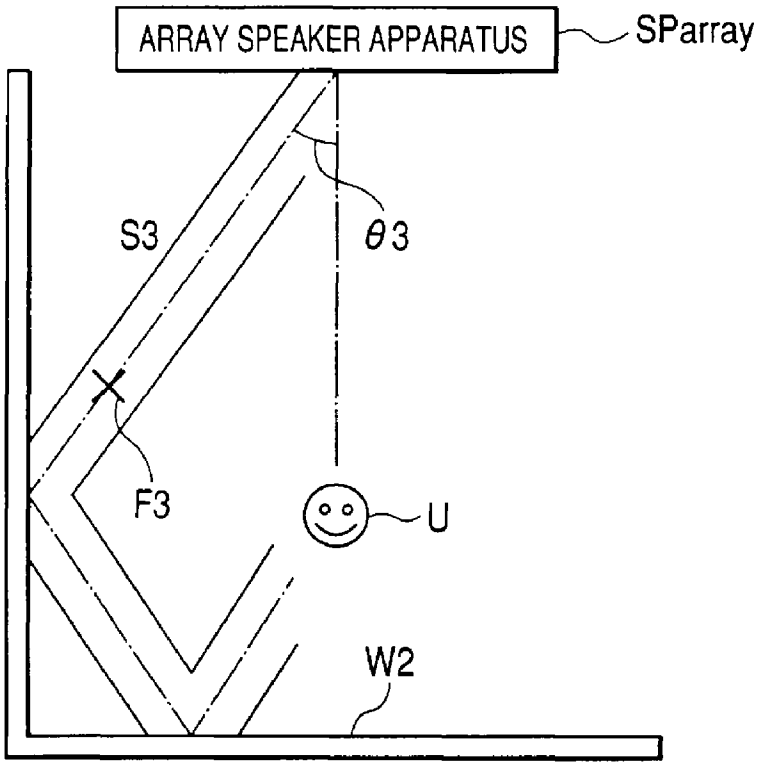

FIG. 5 are views for explaining the principles of this embodiment. FIG. 5 depict only an audio signal of one channel. In addition, a first sound S3 and a second sound S4 are illustrated separately in FIG. 5(*a*) and FIG. 5(*b*) in order to explain them easily to understand. In fact the first sound S3 and the second sound S4 are output concurrently. Therefore, FIG. 5(*a*) and FIG. 5(*b*) should be superimposed on each other.

In this embodiment, the first sound S3 of the middle/high frequency band easy to control is radiated to be once reflected by a wall surface W2 at the rear of a listening position and then arrive at the listening position U. In this event, it is assumed that the angle between the frontal direction of the array speaker apparatus SParray disposed to face the listening position U and the radiation direction of the sound S3 is θ3. The thickness of a conceptual beam of the first sound S3 is narrow as shown in FIG. 5(*a*).

On the other hand, the second sound S4 of the low frequency band is radiated with the radiation direction thereof set as θ4 (θ3<θ4). Since the radiation direction θ4 of the second sound S4 is made larger than the radiation direction θ3 of the first sound S3, the center of the beam of the second sound S4 reflected by the wall surface W2 at the rear of the listening position is displaced from the listening position U. However, the conceptual beam of the second sound S4 is thicker than the first sound S3. Therefore, the radiation direction θ4 can be set so that a part of the beam can reach the listener. When the radiation direction θ4 is made larger than the radiation direction θ3, the center of the beam of the second sound S4 goes through a site at a distance from the listener. It is therefore possible to reduce the sound pressure energy of the low frequency band frontally traveling from the array speaker apparatus SParray directly to the listening position U.

In this manner, according to the this embodiment, an audio signal of a surround channel is divided into an audio signal of a middle/high frequency band and an audio signal of a low frequency band, and the audio signal of the middle/high frequency band is controlled to be reflected by the wall surface W2 at the rear of the listening position and then travel to the listening position U accurately. Thus, a virtual sound source is fixed on the wall surface W2. On the other hand, the audio signal of the low frequency band is controlled not to fix its sound source but to reduce a sound traveling directly from the frontal direction. Thus, the sound image formed in the middle/high frequency band is prevented from being pulled back to the array speaker side. According to the system of this embodiment, a high-frequency component and a low-frequency component of the audio signal seem to be separated. In fact, however, the audio signal can be listened to as an integrated sound without any sense of artificiality. This is because auditory psychological effect such that human hearing is rearranged by brains in accordance with experiences can be used.

Figure 6:
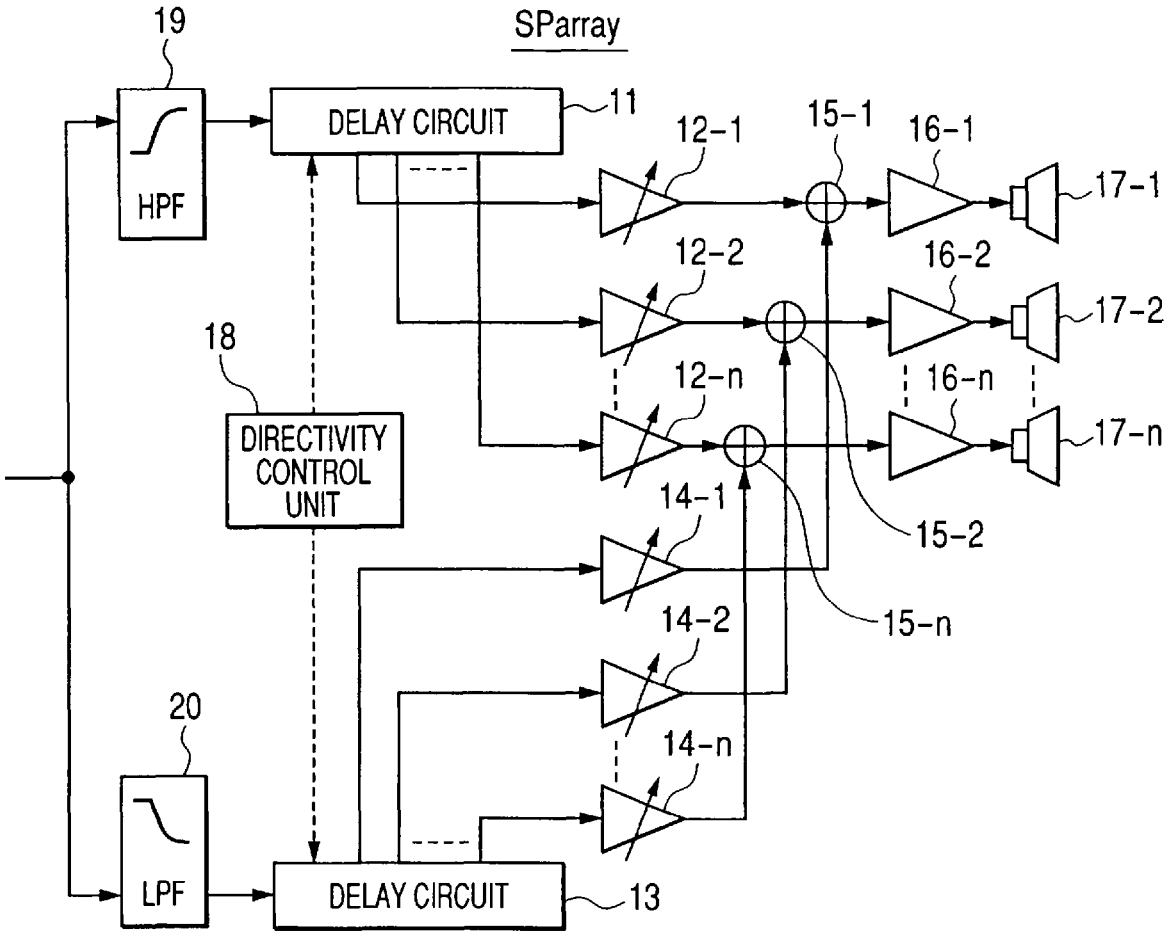
FIG. 6 is a block diagram showing the configuration of the array speaker apparatus according to the second embodiment of the present invention.

FIG. 6 is a block diagram showing the configuration of the array speaker apparatus SParray according to this embodiment. The array speaker apparatus SParray in FIG. 6 includes a high pass filter 19 for extracting a first audio signal of a middle/high frequency band from an input audio signal, a low pass filter 20 for extracting a second audio signal of a low frequency band from the input audio signal, a delay circuit 11 for adding delay times corresponding to intended directivity to an output signal of the high pass filter 19, multipliers 12 (12-1 to 12-*n*) for multiplying the outputs of the delay circuit 11 by gain coefficients so as to adjust the outputs into desired levels, a delay circuit 13 for adding delay times corresponding to intended directivity to an output signal of the low pass filter 20, multipliers 14 (14-1 to 14-*n*) for multiplying the outputs of the delay circuit 13 by gain coefficients so as to adjust the outputs into desired levels, adders 15 (15-1 to 15-*n*) for adding output signals of the multipliers 12 to output signals of the multipliers 14, amplifiers 16 (16-1 to 16-*n*) for amplifying output signals of the adders 15, speaker units 17 (17-1 to 17-*n*) to be driven by the amplifiers 16, and a directivity control unit 18 for setting the delay times of the delay circuits 11 and 13. In the same manner as in FIG. 5, only an audio signal of one channel is depicted in FIG. 6.

The delay circuit 11 and the multipliers 12 constitute the aforementioned first audio signal processing circuit, and the delay circuit 13 and the multipliers 14 constitute the second audio signal processing circuit.

An input audio signal is input to the high pass filter 19 and the low pass filter 20, and divided into frequency bands.

The first audio signal of the middle/high frequency band output from the high pass filter 19 is input to the delay circuit 11 so as to form signals to which delay times are added by the delay circuit 11 respectively and whose number corresponds to the number of speaker units. In this event, the delay time the delay circuit 11 adds to the first audio signal to be supplied to each speaker unit 17-*i* (i=1, 2, . . . n) is adjusted so that a first sound S3 radiated from the speaker unit 17-*i* is reflected by the wall surface W2 at the rear of the listening position and then arrive at the listening position U. That is, the delay time of the delay circuit 11 is calculated for each speaker unit by the directivity control unit 18 based on the position of a focus F3 set so that the beam of the middle/high frequency band is reflected two or three times and then travels from the wall surface W2 to the listening position U, and the position of each speaker unit 17-1 to 17-*n*. The delay times calculated thus are set in the delay circuit 11.

The first audio signals added with the delay times by the delay circuit 11 are adjusted into desired levels by the multipliers 12-1 to 12-*n*. The first audio signals may be multiplied by predetermined window function coefficients by the multipliers 12-1 to 12-*n* respectively.

On the other hand, the second audio signal of the low frequency band output from the low pass filter 20 is input to the delay circuit 13 so as to form signals to which delay times are added by the delay circuit 13 respectively and whose number corresponds to the number of speaker units. In this event, the delay time the delay circuit 13 adds to the second audio signal to be supplied to each speaker unit 17-*i* (i=1, 2, . . . n) is adjusted so that the radiation direction θ4 of the second sound S4 radiated from the speaker unit 17-*i* becomes larger than the radiation direction θ3 of the first sound S3. That is, the delay time of the delay circuit 13 is calculated for each speaker unit by the directivity control unit 18 based on the position of a focus F4 set so that the radiation direction θ4 becomes larger than the radiation direction θ3, and the position of each speaker unit 17-1 to 17-*n*. The delay times calculated thus are set in the delay circuit 13.

The second audio signals added with the delay times by the delay circuit 13 are adjusted into desired levels by the multipliers 14-1 to 14-*n*. The second audio signals may be multiplied by predetermined window function coefficients by the multipliers 14-1 to 14-*n* respectively.

Subsequently, the outputs of the multipliers 12-1 to 12-*n* are added to the outputs of the multipliers 14-1 to 14-*n* by the adders 15-1 to 15-*n*. The outputs of the adders 15-1 to 15-*n* are amplified by the amplifiers 16-1 to 16-*n*, and sounds are radiated from the speaker units 17-1 to 17-*n*. Signals output from the speaker units 17-1 to 17-*n* respectively interfere with one another in the space so as to form a beam of the first sound S3 reflected two or three times and then traveling toward the listening position U and a beam of the second sound S4 different from the first sound S3. The first sound S3 travels to the listening position U from the wall surface W2 at the rear of the listening position so as to form a virtual sound source behind the listener.

In such a manner, according to this embodiment, it is possible to solve the problem that sense of the sound image fixed-position of the surround channels (rear signals SL and SR) is wrong in a surround-sound system using an array speaker.

As a method for controlling the second sound S4 of the low frequency band, this embodiment uses a method in which the radiation direction θ4 is made larger than the radiation direction θ3 of the first sound S3 so that the center of the beam of the second sound S4 passes through a site at a distance from the listener so as to reduce the sound pressure of the low frequency band in the frontal direction of the array speaker apparatus SParray. As another control method, there is a method in which the focal length of the second sound S4 is increased. When the focal length is increased, the shape of the beam of the second sound S4 becomes so narrow that the sound pressure of the low frequency band in the frontal direction of the array speaker apparatus SParray can be reduced.

Figure 7:
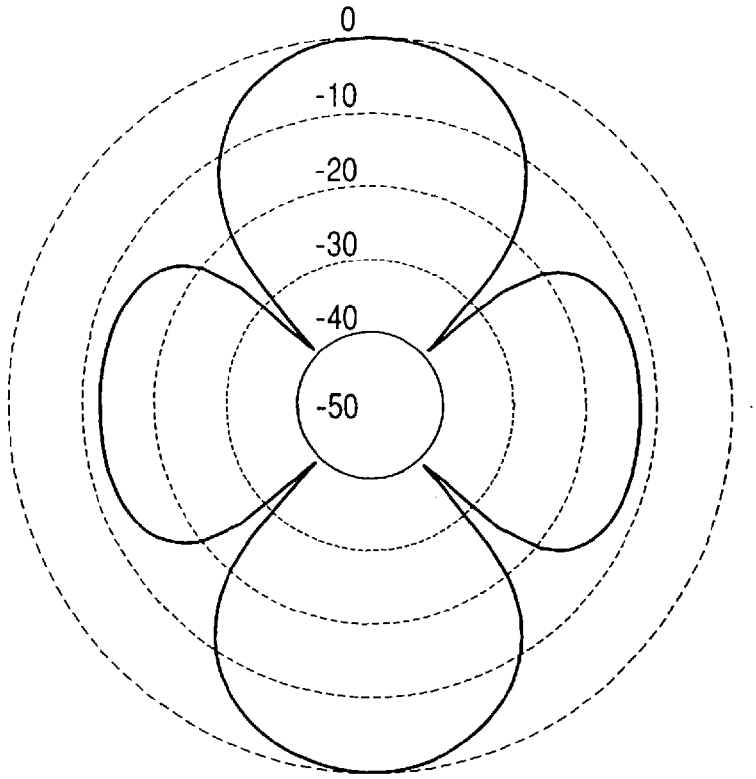
FIG. 7 is a diagram showing an example of a polar pattern.

As another method for controlling the second sound S4, there is a method in which the focus of the second sound S4 is set so that a valley of the directivity distribution is formed in the frontal direction of the array speaker apparatus SParray. FIG. 7 shows an example of a polar pattern of an array speaker. It can be seen that a valley of sound pressure is formed between an upper main lobe in FIG. 7 and a lateral side lobe in FIG. 7. The angle with which this valley is formed is changed in accordance with the frequency. The focus of the second sound S4 is set so that the valley of the directivity distribution in the low frequency band is located in the frontal direction.

As another method for controlling the second sound S4, there is a method in which the focus of the second sound S4 is set so that the direction with which the first sound S3 is incident on the listening position U and the direction with which the second sound S4 is incident on the listening position U become symmetric with respect to a line connecting the two ears of the listener. In this method, for example, when the first sound S3 arrives at the listening position U from the left oblique rear thereof, it will go well if the second sound S4 is designed to arrive at the listening position U from the left oblique front thereof. A binaural time difference which is a human method for recognizing a fixed position is liable to error as to the front/rear direction. According to this method, therefore, the fixed position of the low frequency band becomes ambiguous so that it can be expected not to interfere with the fixed position of the high frequency band.

There is also a method in which the gain of each second audio signal is set to be smaller than the gain of each first audio signal in order to prevent the sound image formed by the middle/high frequency band from being pulled back to the array speaker side by the low frequency band. To this end, the gain ratios can be adjusted by adjusting the gain coefficients of the multipliers 12 and 14.

It is also preferable in this embodiment that there is no difference in arrival time between the first sound S3 and the second sound S4 listened to at the listening position U. To this end, the delay circuits may be used to adjust the delay times so that the first sound S3 and the second sound S4 can arrive at the listening position U simultaneously. The delay times for this adjustment can be added by adjustment (addition) of delay quantities of the delay circuit 11 or the delay circuit 13. In some methods etc. of band division, it is likely that the fixed position on the high frequency band side will be improved when the low-frequency beam side is delayed temporally.

Although FIGS. 5 and 6 depict only one channel (rear signal SL) of the surround channels, in fact the aforementioned processing is performed upon each of the two channels of the rear signals SL and SR or three or more sound channels. In order to improve the sense of surround sound, for example, a method in which a plurality of beams of each rear signal SL, SR are output to create a plurality of virtual sound sources for each rear signal SL, SR is also effective.

Third Embodiment

Next, description will be made about a third embodiment of the present invention. As described in the second embodiment, the directivity of the low frequency band is not as acute as that of the high frequency band. Therefore, there is a small difference between the sound pressure energy in the radiation direction and the sound pressure energy in the frontal direction of the array speaker apparatus. On the contrary, the sound pressure of the high frequency band is attenuated suddenly in a position out of the beam center. Accordingly, a range where a frequency balance with the low frequency band is good is narrow. That is, an area where good listening can be secured is narrow. A sound closer to a natural sound and better in frequency balance has a better sense of fixed position. To this end, this embodiment is to correct a difference in directivity shape between frequency bands.

Figure 8:
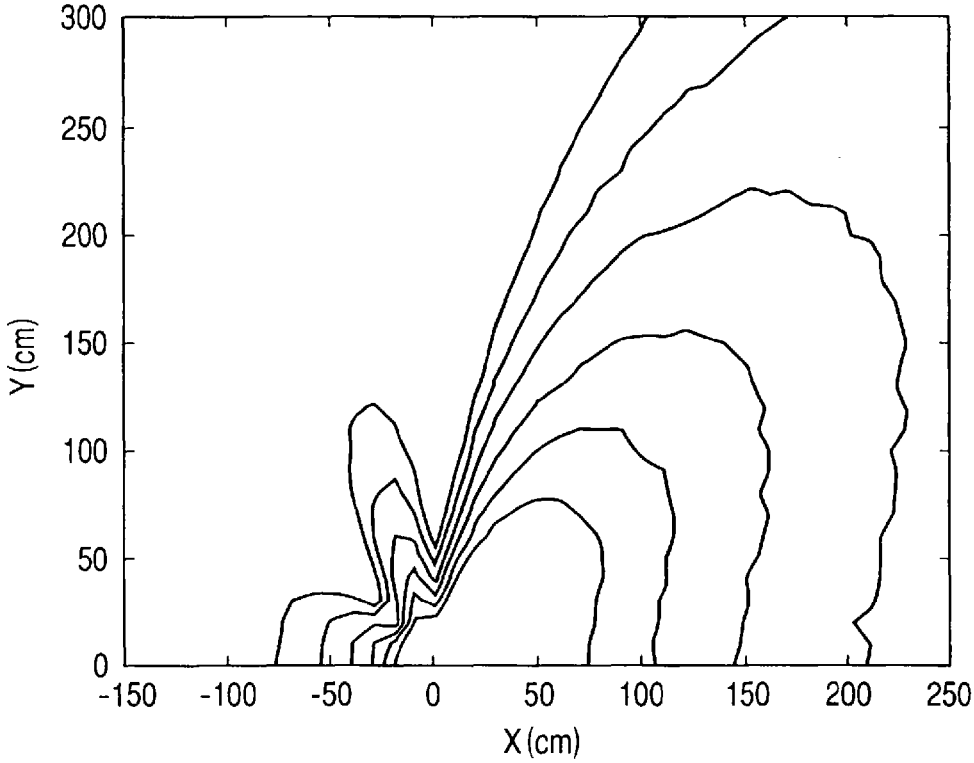
FIG. 8 is a graph showing an example of directivity of the array speaker apparatus when the array width is 23.75 cm.

As shown in FIGS. 3 and 4, 2 kHz has much stronger directivity than 500 Hz. Here, FIG. 8 shows directivity of 2 kHz when the width of the array speaker is 23.75 cm. This directivity has a shape extremely close to that of FIG. 4. That is, the main lobe width of the directivity depends on the ratio between the signal wavelength and the array width. In the example of FIG. 8, ¼ (23.75 cm/95 cm) of the array width corresponds to ¼ (2 kHz/500 Hz) of the signal wavelength. In such a manner, the directivity properties can be made similar over a wide frequency range if the array width is shortened when the wavelength is short, that is, when the frequency is high.

In the array speaker apparatus SParray according to this embodiment, a low pass filter is inserted behind each output of a delay circuit of a background-art array speaker apparatus. This low pass filter is set so that the cut-off frequency becomes lower as a corresponding speaker unit is located at a larger distance from the center of the array speaker.

Figure 9:
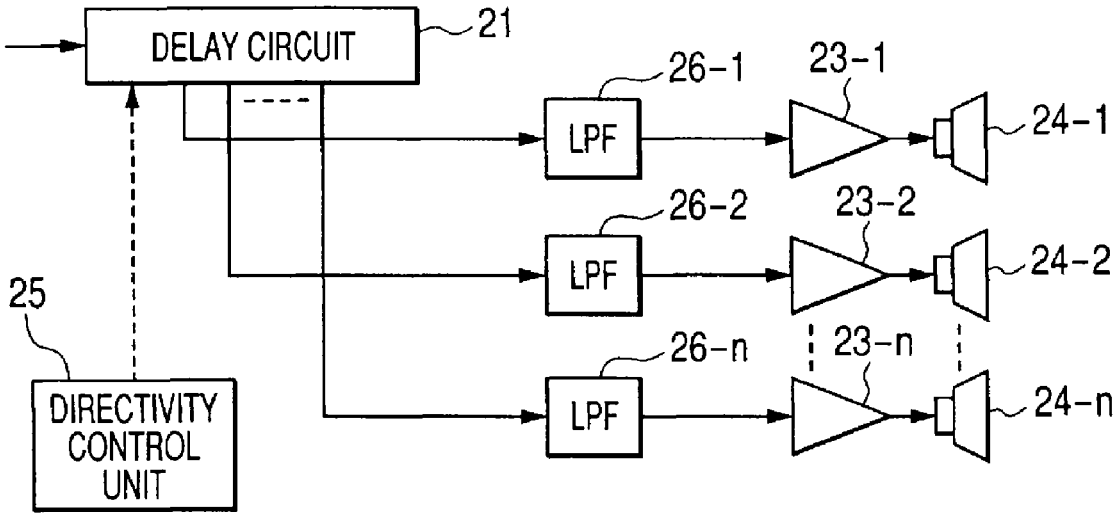
FIG. 9 is a block diagram showing the configuration of an array speaker apparatus according to a third embodiment of the present invention.
Figure 10:
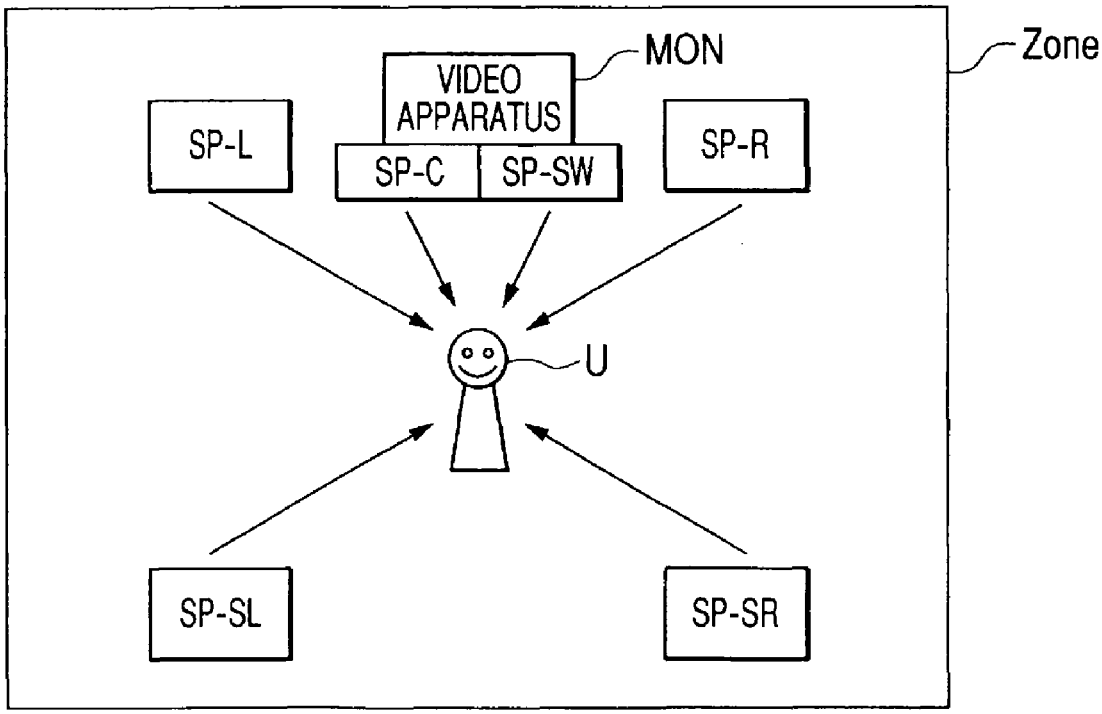
FIG. 10 is a plan view showing an example of a speaker layout in a digital surround-sound system.

FIG. 9 is a block diagram showing the configuration of the array speaker apparatus SParray according to this embodiment. The array speaker apparatus SParray in FIG. 9 includes a delay circuit 21 for adding delay times corresponding to intended directivity to an input audio signal, low pass filters 26 (26-1 to 26-*n*) for filtering outputs of the delay circuit 21, amplifiers 23 (23-1 to 23-*n*) for amplifying outputs of the low pass filters 26, speaker units 24 (24-1 to 24-*n*) to be driven by the amplifiers 23, and a directivity control unit 25 for setting the delay times of the delay circuit 21. Only an audio signal of one channel is depicted in FIG. 9.

An input audio signal is input to the delay circuit 21, and formed into signals to which delay times are added by the delay circuit 21 respectively and whose number is equal to the number of speaker units. In this event, the delay time the delay circuit 21 adds to the audio signal to be supplied to each speaker unit 24-*i* (i=1, 2 . . . n) is adjusted so that a sound radiated from the speaker unit 24-*i* travels toward a focus set desirably. That is, the delay time of the delay circuit 21 is calculated for each speaker unit by the directivity control unit 25 based on the position of the focus and the position of each speaker unit 24-1 to 24-*n* in the same manner as in a background-art array speaker apparatus. The delay times calculated thus are set in the delay circuit 21.

The audio signals added with the delay times by the delay circuit 21 pass through the low pass filters 26-1 to 26-*n* having properties corresponding to the positions of the corresponding speaker units 24-1 to 24-*n*, respectively. The outputs of the low pass filters 26-1 to 26-*n* are amplified by the amplifiers 23-1 to 23-*n*, and sounds are radiated from the speaker units 24-1 to 24-*n*.

The speaker units 24-1 to 24-*n* are disposed two-dimensionally on a baffle board of the array speaker apparatus. Each low pass filter 26-*i* (i=1, 2, . . . n) is set so that the cut-off frequency becomes lower as the position of a corresponding speaker unit 24-*i* (the speaker unit to which the audio signal having passed through the low pass filter 26-*i* is supplied) is located at a larger distance from the center of the array speaker. Thus, a low frequency band is radiated from the array speaker apparatus as a whole, while a high frequency band is radiated from only a part of the array speaker apparatus near the center thereof. In addition, components of gain coefficients of the multipliers are folded in filter coefficients of the low pass filters 26. In some cases, window function coefficients may be folded in the filter coefficients. Signals output from the speaker units 24 interfere with one another in the space so as to form directivity. The directivity at this time has a similar shape over a wider frequency range than in the background-art array speaker apparatus.

In such a manner, according to this embodiment, the array width is controlled to be reduced when the signal wavelength is short, that is, when the frequency is high. Thus, the ratio between the signal wavelength and the array width can be nearly constant over a wide frequency range so that the difference in directivity shape between frequency bands can be corrected. As a result, a listening area good in frequency characteristic and good in sense of fixed position can be extended.

Fourth Embodiment

Next, description will be made about a fourth embodiment of the present invention. This embodiment shows another example of the configuration of the third embodiment. An array speaker apparatus according to this embodiment is constituted by a high pass filter for extracting a middle/high frequency band from an input audio signal, a low pass filter for extracting a low frequency band from the input audio signal, a first audio signal processing circuit for processing the audio signal extracted by the high pass filter, a second audio signal processing circuit for processing the audio signal extracted by the low pass filter, adders for adding outputs of the first audio signal processing circuit to outputs of the second audio signal processing circuit, amplifiers for amplifying the outputs of the adders, speaker units to be driven by the amplifiers, and a directivity control circuit constituted by a microcomputer or the like for deciding the directivities of the audio signals. This array speaker apparatus can be implemented by assigning resources of two channels in a background-art array speaker apparatus to an input audio signal of one channel, and adding the high pass filter and the low pass filter.

When the number of divided frequency bands increases, it is likely that an effect closer to an ideal can be obtained. In this case, by use of band pass filters together with the low pass filter and the high pass filter, the configuration may be expanded to output a beam for each of three or more bands.

The configuration of the array speaker apparatus according to this embodiment is similar to the configuration of FIG. 6. Accordingly, description will be made using the reference numerals of FIG. 6. An input audio signal is input to the high pass filter 19 and the low pass filter 20, and divided into bands.

A signal of a middle/high frequency band output from the high pass filter 19 is input to the delay circuit 11, and formed into signals to which delay times are added by the delay circuit 11 respectively and whose number is equal to the number of speaker units. In this event, the delay time the delay circuit 11 adds to the audio signal to be supplied to each speaker unit 17-*i* (i=1, 2, . . . n) is adjusted so that a sound radiated from the speaker unit 17-*i* travels toward a focus set desirably. That is, the delay time of the delay circuit 11 is calculated for each speaker unit by the directivity control unit 18 based on the position of the focus and the position of each speaker unit 17-1 to 17-*n* in the same manner as in the background-art array speaker apparatus. The delay times calculated thus are set in the delay circuit 11.

On the other hand, a signal of a low frequency band output from the low pass filter 20 is input to the delay circuit 13, and formed into signals to which delay times are added by the delay circuit 13 respectively and whose number is equal to the number of speaker units. In this event, the delay time the delay circuit 13 adds to the audio signal to be supplied to each speaker unit 17-*i* (i=1, 2, . . . n) is adjusted so that a sound radiated from the speaker unit 17-*i* travels toward a focus set desirably. That is, the delay time of the delay circuit 13 is calculated for each speaker unit by the directivity control unit 18 based on the position of the focus and the position of each speaker unit 17-1 to 17-*n*. The delay times calculated thus are set in the delay circuit 13. The position of the focus may be the same as that of the high frequency band.

The signals of the low frequency band added with the delay times by the delay circuit 13 are multiplied by window function and gain coefficients by the multipliers 14-1 to 14-*n*.

On the other hand, some signals of the high frequency band added with the delay times by the delay circuit 11, which correspond to speaker units 17 located on the outer side of the array speaker, are multiplied by zero by the multipliers 12, while the other signals corresponding to speaker units on the inner side are multiplied by window function and gain coefficients by the multipliers 12.

The outputs of the multipliers 12-1 to 12-*n* are added to the outputs of the multipliers 14-1 to 14-*n* by the adders 15-1 to 15-*n*. The outputs of the adders 15-1 to 15-*n* are amplified by the amplifiers 16-1 to 16-*n*, and sounds are radiated from the speaker units 17-1 to 17-*n*. Signals output from the speaker units 17-1 to 17-*n* respectively interfere with one another in the space so as to form directivity. The directivity at this time has a similar shape over a wider frequency range than in the background-art array speaker apparatus.

In such a manner, also in this embodiment, effect similar to that of the third embodiment can be obtained.

According to the control in this embodiment, the window function and gain coefficients have to be designed again whenever the array shape and number are changed. In the aforementioned description, an addition process is performed in the adders upon a high frequency band where the signal level becomes zero as a result of multiplication by the window function and gain coefficients. Practically when the multiplication and the addition are omitted, resources can be saved (the number of DSP processes can be cut).

Industrial Applicability

The present invention is applicable to multi-channel surround sound systems using array speaker apparatus.

What is claimed is:

1. An array speaker apparatus comprising:

a plurality of speaker units arranged in an array;

a first delay device that selectively adds a first predetermined delay to a first audio signal for outputting to each of the speaker units, wherein the first audio signal is obtained from an input audio signal;

a second delay device that selectively adds a second predetermined delay to a second input audio signal for outputting to each of the speaker units, wherein the second input audio signal is also derived from the input audio signal; and directivity control device that controls the first and second delay devices, wherein the directivity control device is configured to:

calculate for the first delay device the first predetermined delay for each of the speaker units so that the plurality of speaker units each are driven with the first audio signal processed by the first delay device to form a first sound beam that projects toward a wall on the left or right side of a listening position to form a virtual sound source at the wall;

calculate for the second delay device the second predetermined delay for each of the speaker units so that the plurality of speaker units each are driven with the second audio signal processed by the second delay device to form a second sound beam that projects directly toward the listening position to form a direct sound source; and create a phantom sound image between the direct sound source formed by the second sound beam and the virtual sound source at the wall formed by the first sound beam.

2. The array speaker apparatus according to claim 1, further comprising a sound-characteristic adjusting device that adjusts at least one of a frequency-gain characteristic or a frequency-phase characteristic of at least one of the first audio signal or the second audio signal so that sounds arriving at the listening position have desired properties.

3. The array speaker apparatus according to claim 1, wherein the virtual sound source is located diagonally front with respect to the listening position.

4. An array speaker apparatus comprising:

a high pass filter that extracts a first audio signal of a middle/high frequency band from an input audio signal of a surround channel;

a low pass filter that extracts a second audio signal of a low frequency band from the input audio signal;

a plurality of speaker units arranged in an array;

a first delay device that selectively adds a first predetermined delay to the first audio signal for outputting to each of the speaker units;

a second delay device that selectively adds a second predetermined delay to the second audio signal for outputting to each of the speaker units; and a directivity control device that controls the first and second delay devices, wherein the directivity control device is configured to:

calculate for the first delay device the first predetermined delay for each of the speaker units so that the plurality of speaker units each are driven with the first audio signal processed by the first delay device to form a first sound beam that reaches a wall that is located behind a listening position to form a virtual sound source at the wall; and calculate for the second delay device the second predetermined delay for each of the speaker units so that the plurality of speaker units each are driven with the second audio signal processed by the second delay device to form a second sound beam that projects toward the listening position, while providing a sound pressure level of the second sound beam at the listening position that is lower than a sound pressure level of the first sound beam at the listening position.

5. The array speaker apparatus according to claim 4, wherein the directivity control device drives the plurality of speakers so that a distance from the array speaker apparatus to the location of the wall where the first sound beam is incident upon is farther than the distance from the array speaker apparatus to the listening position.

6. The array speaker apparatus according to claim 4, wherein the directivity control device drives the plurality of speaker units so that an angle between a radiation direction of the first sound beam and a frontal direction of the array speaker apparatus is larger than an angle between a radiation direction of the second sound beam and the frontal direction.

7. The array speaker apparatus according to claim 4, wherein the virtual sound source is located diagonally backward with respect to the listening position.

8. An array speaker apparatus comprising:

a plurality of speaker units arranged in an array;

a first audio signal output device that outputs a first audio signal based on an input audio signal;

a second audio signal output device that outputs a second audio signal based on the input signal; and a first delay device that selectively adds a first predetermined delay to the first audio signal for outputting to each of the speaker units;

a second delay device that selectively adds a second predetermined delay to the second input audio signal for outputting to each of the speaker units;

adders that each output an adding result, of adding the first audio signal processed by the first delay device for one of the speaker units to the second audio signal processed by the second delay device for the one speaker unit, to the one speaker unit; and a directivity control device that controls the first and second delay devices to control the directivity of a first output sound output by the plurality of speaker units based on the first audio signal, and the directivity of a second output sound output by the plurality of speaker units based on the second audio signal, wherein the directivity control device is configured to:

calculate for the first delay device the first predetermined delay for each of the speaker units so that the plurality of speaker units each are driven with the first audio signal processed by the first delay device so that the first output sound is in a form of a first sound beam that project toward a first direction; and calculate for the second delay device the second predetermined delay for each of the speaker units so that the plurality of speaker units each are driven with the second audio signal processed by the second delay device so that the second output sound is in a form of a second sound beam that projects toward a second direction.

9. The array speaker apparatus according to claim 8, wherein each of the first audio signal output device and the second audio signal output device further includes a sound-characteristic adjusting device that adjusts a desired characteristic upon the respective input signal.

10. The array speaker apparatus according to claim 9, wherein the sound-characteristic adjusting device of the first audio signal output device includes a high pass filter, and the sound-characteristic adjusting device of the second audio signal output device includes a low pass filter.

11. The array speaker apparatus according to claim 10, further including:

first multipliers that each adjust the first audio signal processed by the first delay device into a respective desired level for one of the speaker units; and second multipliers that each adjust the second audio signal processed by the second delay device into a respective desired level for one of the speaker units.

12. The array speaker apparatus according to claim 11, wherein a gain coefficient of at least one of the first multipliers is zero.

* * * * *